US007612280B2

(12) United States Patent
Schneider

(10) Patent No.: US 7,612,280 B2
(45) Date of Patent: Nov. 3, 2009

(54) INTELLIGENT AUDIO SELECTOR

(76) Inventor: Andrew J. Schneider, 1545 Franklin St., San Francisco, CA (US) 94109

( * ) Notice: Subject to any disclaimer, the term of this patent is extended or adjusted under 35 U.S.C. 154(b) by 0 days.

(21) Appl. No.: 11/784,702

(22) Filed: Apr. 9, 2007

(65) Prior Publication Data

US 2007/0266843 A1 Nov. 22, 2007

Related U.S. Application Data

(60) Provisional application No. 60/801,768, filed on May 22, 2006.

(51) Int. Cl.
*G10H 1/00* (2006.01)
*G10H 1/18* (2006.01)

(52) U.S. Cl. ..... 84/615; 84/600; 84/601; 84/604; 84/616; 84/618

(58) Field of Classification Search ..... None
See application file for complete search history.

(56) References Cited

U.S. PATENT DOCUMENTS

2003/0205124 A1* 11/2003 Foote et al. ..... 84/608
2005/0160901 A1* 7/2005 Suzuki et al. ..... 84/613
2006/0032363 A1* 2/2006 Platt ..... 84/601
2006/0107822 A1* 5/2006 Bowen ..... 84/612
2007/0074617 A1* 4/2007 Vergo ..... 84/612
2007/0113724 A1* 5/2007 Kim et al. ..... 84/609
2007/0193437 A1* 8/2007 Kong et al. ..... 84/610

* cited by examiner

*Primary Examiner*—Marlon T Fletcher
(74) *Attorney, Agent, or Firm*—Hornkohl Intellectual Property Law PLLC; Jason L. Hornkohl

(57) ABSTRACT

A digital music player includes an audio file selector that selects a subsequent audio file to play from a collection of audio files based upon a desired relationship between an audio characteristic of a current audio file and an audio characteristic of the subsequent audio file. The audio selector digitally analyzes the audio files to determine their audio characteristics. A weighting procedure then assigns weights to the audio files in the collection based upon their audio characteristics and their relationship to the audio characteristics of the current audio file. A random selector then pseudo randomly selects the subsequent audio files from a weighted list of the files. The desired relationship can be a specified correspondence between a key or tempo of the current audio file and a key or tempo of the subsequent audio file. The audio selector is preferably implemented through a software macro which is downloaded into an existing digital music player.

18 Claims, 2 Drawing Sheets

INTELLIGENT AUDIO SELECTOR

CROSS-REFERENCES TO RELATED APPLICATIONS

The present application is based upon and claims priority from U.S. Provisional Patent Application Ser. No. 60/801,768, filed May 22, 2006.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

FIELD OF THE INVENTION

The present invention is directed toward an intelligent audio selector that selects an audio file from a library of audio files for play back based upon audio characteristics of a currently playing audio selection and corresponding weighted audio characteristics of the subsequently selected file. More particularly, a preferred embodiment of the present invention is directed toward software for use in a digital music player that determines a desired correspondence between a currently playing track and a subsequently selected track and then selects a track having the desired audio characteristics from a library of tracks for playback based upon a set of assigned weights.

BACKGROUND OF THE INVENTION

Digital audio players are pervasive devices that allow users to listen to music from stored databases of audio files. More and more people are using their computers, portable media players, and hard drive-based audio playback systems exclusively for listening to music, and very commonly on random play or in groups of similar songs from similar artists and albums. However, current methods of automatic audio selection lack the humanistic playback qualities of their organic human disc jockey predecessors. Unfortunately, the skilled radio jock that knows what songs blend well with each other has been removed from the every day playback chain. In addition, the concept of playing an album from start to finish and the telling of the linear story that the artist intended to portray when his album was created is lost when listening to randomly selected tracks that bear no acoustic relation to the preceding or subsequently selected track. Thus, personal hard drive and flash-based digital music playback has virtually eliminated the live, on-air music DJ's synergistic touch and has fractured the artist's artfully programmed album listening experience. Portable media player development is also moving into its next phase of mass consumer acceptance such that the devices are becoming commoditized, and in need of unique differentiating features that help them stand out in the market place. Therefore, in light of the above discussed problems, what is needed is an audio selector that automatically selects audio files such that a listener is provided a more enjoyable, cohesive, and organic-sounding listening experience that is similar to one that one would hear from a live, skilled DJ.

SUMMARY OF THE INVENTION

An embodiment of the present invention is directed toward an audio player that includes an audio file selector that selects a subsequent audio file to play from a collection of audio files based upon a desired relationship between an audio characteristic of a current audio file and an audio characteristic of the subsequent audio file. The audio selector digitally analyzes the audio files to determine the audio characteristics. Weights are assigned to the audio files based upon a desired correspondence between the audio characteristics of sequential files. The desired correspondence between sequentially played files is set forth in a digital file matching table. The desired correspondence can be between a key of the current audio file and a key of the subsequent audio file. The desired correspondence may also include a specified correspondence between a tempo of the current audio file and a tempo of the subsequent audio file or any other determinable characteristic. Preferably, a random selector pseudo randomly selects the subsequent audio files from a weighted list of files. The audio selector is also preferably implemented through a software macro which is downloaded into an existing digital music player.

Another embodiment of the present invention is directed toward a method of selecting an audio file from a collection of audio files and playing the selected audio file. In accordance with the method, an audio characteristic of a currently playing audio file is determined by digitally analyzing the currently playing audio selection. The collection of audio files is then processed to detect acoustic characteristics of the audio files in the collection. Weights are assigned to the files in the library based upon the files having a desired acoustic relationship with the currently playing file. The desired acoustic relationship can include a specified correspondence between a tempo or key of the currently playing audio file and a tempo or key of the subsequent audio file. A subsequent audio file is randomly selected from a weighted list of the audio files. The subsequently selected audio file is then played.

Yet another embodiment of the present invention is directed toward software for selecting a subsequent audio selection from a library of audio files based upon an initial audio selection. The software includes audio analysis software for digitally analyzing the initial audio selection and the audio files in the library to identify audio characteristics in the files having a predetermined relationship with the audio characteristics of the initial audio selection. The predetermined relationship is preferably based upon a file matching table. Tempo identification software is used to determine a tempo of an audio file and key identification software determines a key of an audio file. A weight is assigned to each file based upon the file's audio characteristics correspondence with the initial audio selection's audio characteristics. A subsequent audio selection is then randomly selected from a weighted list of the audio files. To eliminate the possibility of processing delays, the software preferably selects at least two subsequent songs to play based upon the initial selection. Each file is assigned a file identification number such that no file is repeatedly selected.

DETAILED DESCRIPTION OF THE INVENTION

An embodiment of the present invention harmonizes a series of songs played by a music player in accordance with a weighted, randomized electronic music playback scheme. Electronic media players, both computer-based and portable, are the dominant means of listening to music. However, the random shuffle features of these music players lack the humanistic playback qualities of their human disc jockey predecessors in that the randomly selected songs are played in a sequential order that is independent of whether or not the songs are actually related to each other in any manner. The present invention alleviates the dissonance between the playing of a series of unmatched songs by employing weighted, acoustic parameter selection based music mixing.

A preferred embodiment of the present invention is incorporated into an existing music playback application or playback device as a software plug-in to reach the widest possible audience without the need for users to migrate their media files to entirely new programs or devices. However, the present invention can also be embodied in a self-contained piece of software or hardware and used in digital music players, retail environments, nightclubs, and commercial applications where maintaining an enjoyable music atmosphere is important. The preferred embodiment relies upon acoustic detection technology as its means of identifying selected acoustic information from the songs in a listener's music library and sequencing through the music files in the library in an acoustically pleasing manner based upon a matching weight assigned to each song.

Figure 1:
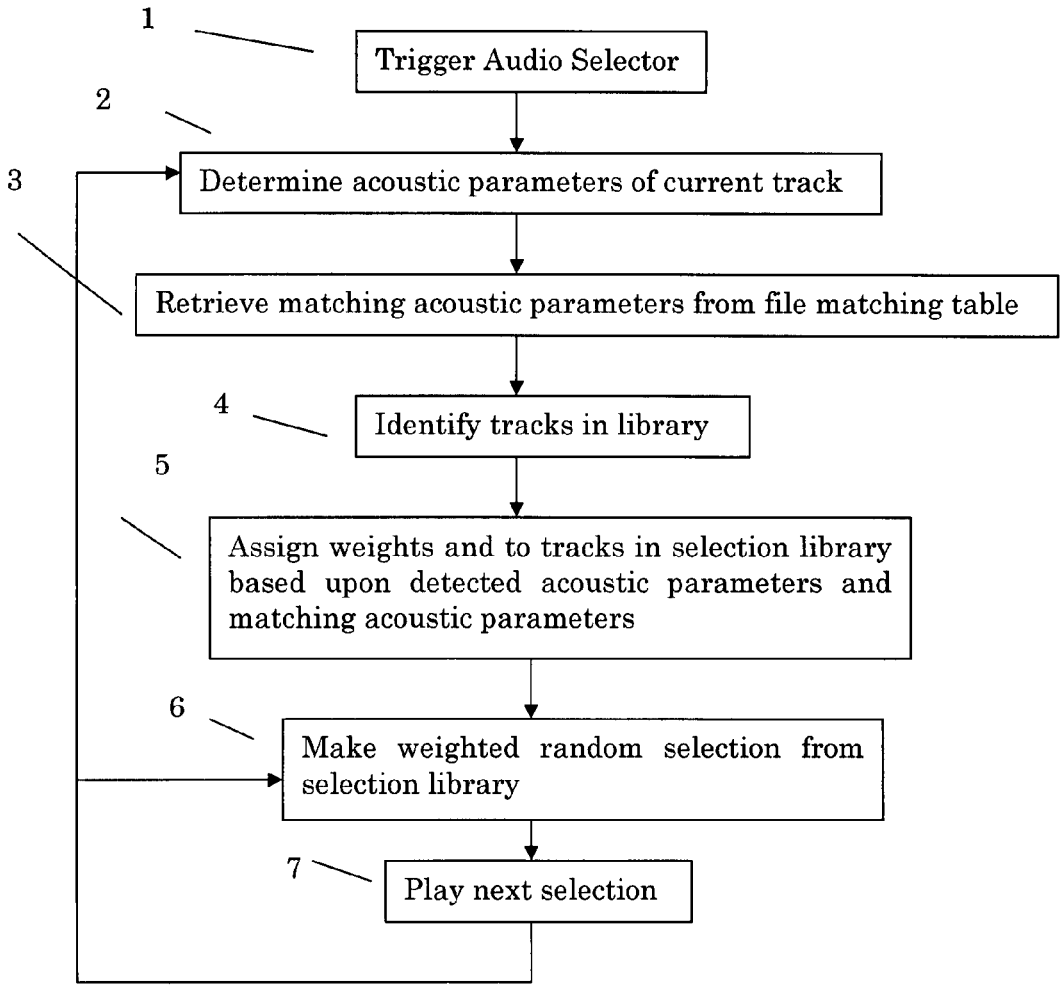
FIG. 1 is a flow chart of a method of automatically selecting a song for playback in accordance with an embodiment of the present invention.

Referring now to FIG. 1, a flow chart of a method of selecting a track for playback in accordance with an embodiment of the present invention is shown. The method works by calculating weights for tracks and then returning track selections based upon those weights. The method begins in block 1 with the triggering of the digital jockey audio selector (DJAS) system. The DJAS system can be triggered in number of ways such as by pressing a button, selecting the feature from a menu, or simply turning on the music playing device. The exact method of triggering the system will of course depend upon the particular application in which the system is being implemented and the preferences of the user.

In block 2, the selected acoustic characteristics of the currently playing track, such as the track's rhythm, beat, key, tempo, etc., are determined. In the preferred embodiment, this is accomplished by audio processing software that detects the key and tempo of the current selection and saves the key and tempo information for later reference. However, the acoustic information may also be retrieved from a digital look up table if provided by the format of the digital recording or music player.

In the embodiment of FIG. 1, a matching table, as shown in block 3, is used is used to retrieve a matching output acoustic schema. The output schema contains a set of matching acoustic, such as key and tempo, criteria for a subsequent audio track to have the desired relationship with the acoustics of the currently playing audio selection. For example, in accordance with the weighting selection scheme of a preferred embodiment, if the currently playing song is in the key of A, there is a 30% weighted chance that the next selected upcoming song will also be in A, a 20% chance that it will be in B, a 20% chance that it will be in D, a 15% chance that it will be in F, and a 15% chance it will be in G. The most harmonically pleasing set of likelihoods is to some degree a matter of taste and individual preference. Therefore, customized audio selection schemes can preferably be created by the user that transition in a user selected manner for a further personalization of the selection process.

Each track is identified and assigned a play list identification number in step 4. This is done, if desired, to insure that no track will be played twice before every track is played once. Other methods for preventing repeated playing of certain tracks are discussed in more detail below. A log of played songs is created and referenced during the track selection process and the played songs are eliminated from the selection library before a rotation through the selection library is complete. A preferred embodiment of the present includes software procedures that deal with play list management. The software allows the songs made available to the audio selector to be selected to be limited based upon additional musical characteristics, such as genre, artist and various other user-defined tags. The tags can also be used to generate subsets of lists to automatically remove undesired categories of digital files, such as pod casts video or non-musical audio tracks, from the selection process through the use of elimination criteria, or automatically include tracks using desired terms in a play list that are identified by examining track file information or utilizing voice recognition software.

Despite the innate randomization built into the weighted table selection system, the audio selector system may still be inclined to continually reselect the same two tracks that share the greatest compatibility for certain small or otherwise unusual libraries. In order to prevent this behavior, each track is identified and assigned a play list identification number in step 4. This is done, if desired, so that DJAS will eliminate previously played tracks from the available pool of tracks. Those skilled in the art will recognize in light of the present disclosure that repeated play back can be prevent in accordance with a number of rules that are preferably user selectable. For example, the rules may prevent a track from being played if the track was previously played less than a given number of minutes before. The track can also be eliminated if it will be played twice prior to a certain percentage of the available library having been played at least once or less than a certain number of tracks were played from the available pool since the track was last played. The selection and combination of these rules can be based on the size of the library and/or any attribute of the playing device, or its hardware or software.

By first examining the entire selected library of files, the key or "root note" of a user's music library may be determined such that the audio selector sequences through the available songs melodically and according to their harmonic compatibility based upon a matching schema. This achieves a melodically synergistic effect between the tracks as they transition from one track to the next, effectively allowing the user's music to sound more organically sequenced during short or long term listening sessions. This is much like the effect imparted by a skilled club deejay. Thus, the system makes listening to music more enjoyable and, since most listeners enjoy this blending effect subconsciously, the invention has benefits indiscriminately of one's taste in music. The melodic, variable synergy between the tracks allows the listener to enjoy the tracks being played from beginning to end.

Since all music contains measurable acoustic characteristics, the present invention can achieve the same cohesive listening experience for any type or grouping of songs for any listening duration as though the music were being played by a skilled deejay.

Once the desired schema is obtained and the content of the selection library identified, a weight can be calculated for each song in the library. In block 5, a set of weights are assigned to the tracks or songs in the selected library based upon the weighting scheme set forth in the matching table and the detected acoustic characteristics of the tracks. A weight is preferably assigned to each file, or each acoustic characteristic of each file, retrieved from the library. In the preferred embodiment, the assigning of the weights is performed by a populate weights procedure which generates weights for each song in the selected play list. When this weight populating procedure runs, it assigns a weight to each song in the selected play list and records the weight in a table. The user preferably has the option to alter the weights assigned to particular acoustic characteristics so they can customize the matching characteristics of the output schema. Based on the custom user inputs, the procedure then assigns corresponding weights to the tracks in the play list.

In block 6, the next track is pseudo randomly selected from the available tracks based upon the determined weights of the tracks in the selection library. Preferably, each song is assigned a weight and a number range created that corresponds to the track's weight. A random number is then selected within the total range of weight numbers and the song whose weight number range contains the number is selected. Due to the increased number range of the heavily weighted songs, they are more likely, but not certain to be played. Each track may be assigned its own weight and selected based upon its own individual merits. Alternatively, a series of subsets of the current library may be created that meet certain acoustic, tempo and/or key criteria set forth in the schema. A track is then randomly selected from the appropriate subset specified in the schema. In one such embodiment, tempo values are assigned to each track in the library and a second set of track subsets, each consisting of songs having similar tempos, is created. A track is then selected from a tempo subset that bears a desired tempo relation to the currently playing track.

In block 7, the matching selection is played. Through the weight pseudo random selection process, the audio selector insures that the sequential tracks will have the strongest desired acoustic relationship with the previously played tracks as possible given the tracks available over the course of playing the selected play list. Once the selection made, the method returns to step 2 or 6, depending upon the particular implementation, and proceeds to select the next track. Nevertheless, the preferred output of the selection procedure is simply an instruction to the audio player to play the selected song:

The preferred rack sequencing process operates under the rules of a musical scale schema with different track outcomes based on predefined track likelihoods. These schemas are derived from the respective acoustic qualities of each analyzed track. During pseudo random play, the acoustic properties of the currently playing track triggers the appropriate schema and, based on the chance outcome, determines the desired acoustic properties of the upcoming track. The system then selects a track from the user's media library that possesses the desired acoustic properties. The acoustic properties of the next track are either determined at initialization, when a track is added to a play list, or determined in the background while a track is playing. As the two tracks transition, a musically pleasant acoustic effect is achieved just as if the tracks were written to be played one after the other. This process repeats with each subsequent song the software selects during the user's listening session, creating a continuously harmonized "set" of songs from the user's electronic music library. The track selection process preferably occurs invisibly to a user of the system and creates no intrusive lags or interruptions in the user's listening experience.

The actual weighting and track outcomes are subject to change and modification as desired, however, the manner of execution for the weighting schema preferably remains substantially constant. To prevent the system from favoring certain tracks (i.e. playing some songs more frequently than others), a measured amount of key impartiality may be taken into account in embodiments using key based subsets. Key impartiality insures that no songs are eliminated from the rotation and that the number of times a song having a certain key has been played is taken into account when making a selection. Thus, the system remembers which songs have been played and insures that the same key tracks, or overly similar groups of tracks, are not repeatedly selected. The system can also be configured such that all of the songs on the play list are eventually played even if some relatively uneven song transitions need to be made. Of course not all songs are sung or played in perfect pitch. The audio detection system preferably compensates for this by allowing a +/−4% maximum pitch deviation. This amount of deviation allows an acceptable amount of pitch variation without being dissonantly detectable to the human ear.

An embodiment of the present invention may be configured to examine every song in the library and determine an order in which to play the entire library. By examining each selection in the library prior to selecting a song, the audio selector can take into account any hard to match songs or tracks and insure that the last songs selected will not involve unnecessarily awkward transitions.

When the system is initialized, a software routine runs an acoustic property detection analysis routine on the music listener's music library and creates an electronic tag recognizable to the audio selector system for each track. During audio selector enabled random play, the key of the currently playing track triggers the appropriate key schema and, based on the tracks' keys as set forth in their tags and an element of chance outcome, the system determines the order in which to play the tracks in the library. When the system detects that new tracks have been added to the library, the system automatically analyzes the tracks, produces an appropriate tag and determines a track sequence for the library.

Figure 2:
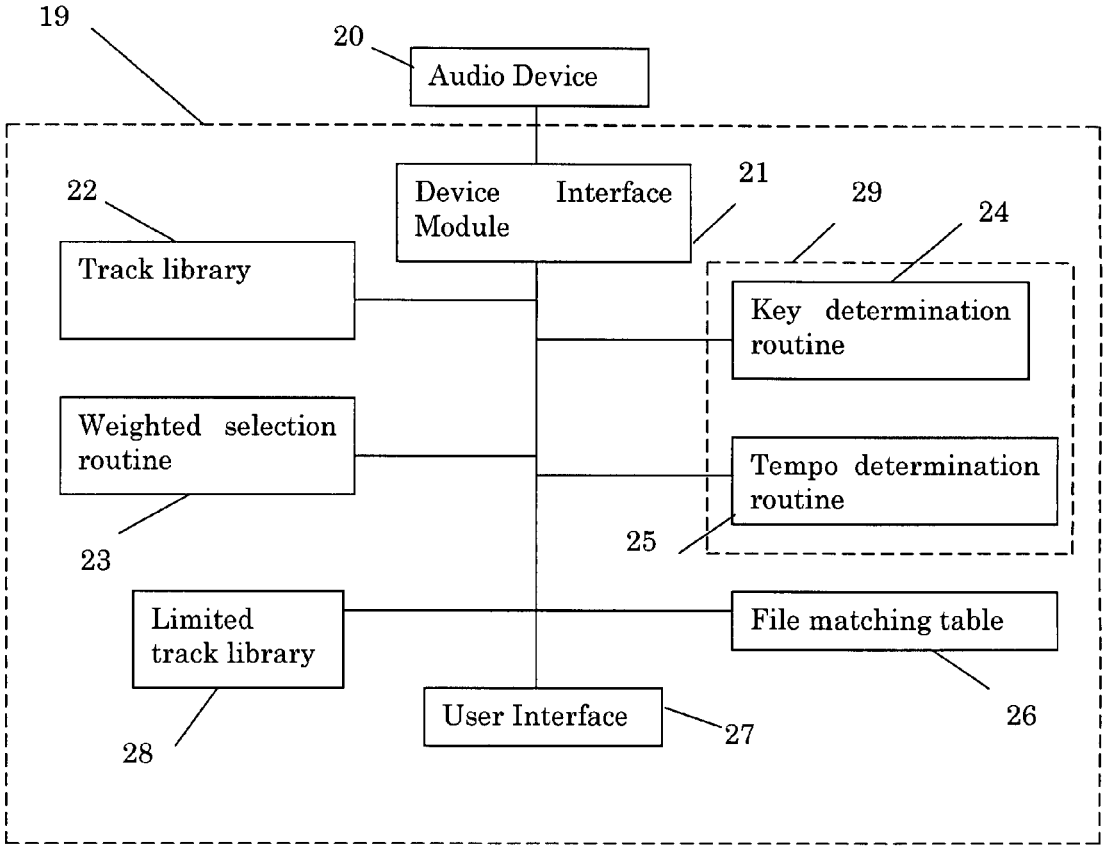
FIG. 2 is a block diagram of software for implementing an audio selector constructed in accordance with an embodiment of the present invention.

Referring now to FIG. 2, a block diagram of software 19 for implementing an automatic audio selector constructed in accordance with an embodiment of the present invention is shown. The software 19 includes a device interface module 21 that allows the audio selector software 19 to communicate with a particular audio device 20 such as a designated brand of digital music player or an operating system of a personal computer. The audio selector software 19 may include a number of device interface modules 21 such that a single set of software 19 can be used with a wide variety of different audio devices or a single device interface module 21 such that different software is required for each different type of audio device. The software 19 further includes a track selection library 22 that is filled with tracks, or track tags, that have been compiled from a library of tracks or songs accessible by the audio device 20. The tags contain information obtained by processing the digital tracks with acoustic software 29 that determines acoustic properties of the tracks. In the embodiment of FIG. 2, the tags are produced by a key determination routine 24 that determines the key of each of the tracks in the audio device's library and a tempo determination routine 25 that determines the tempo of each track in the library. The key determination routine 24 and the tempo determination routine 25 also determine a key and tempo for a currently playing tack on the audio player 20. The current track's tempo and key are then used to look up a set of subsequent track criteria contained in a file matching table 26. The criteria from the file matching table 26 are then compared to the tags of the tracks stored in the track library 22 to determine what available tracks satisfy the criteria. Tracks, or tags of tracks, that satisfy the criteria are stored in a potential selection library 28. Finally, a weighted selection routine 23 assigns weights to the tracks based upon their tags and pseudo randomly selects a suitable track from the track library 22, or limited library 28 as discussed in more detail above, based upon the assigned weights. The device interface software 21 then instructs the audio device 20 to play the selected track. A user interface 27 allows a user of the audio selector system to enable the audio selector and to choose selection criteria such as limited play lists or customized key and tempo matching schemes. The software of FIG. 2 thus provides the automatic selection functionalities discussed with above respect to FIG. 1.

Although there have been described particular embodiments of the present invention of a new and useful INTELLIGENT AUDIO SELECTOR, it is not intended that such references be construed as limitations upon the scope of this invention except as set forth in the following claims.

What is claimed is:

1. An audio player comprising:

an audio file selector that selects a subsequent audio file to play from a collection of audio files based upon a desired relationship between an audio characteristic of a current audio file and an audio characteristic of said subsequent audio file by examining digital information corresponding to an audio characteristic of said current audio file and at least a portion of said audio files in said collection and assigning weights to said audio files in said collection based upon a specified file matching scheme, defining a range equal to the total of all assigned weights, assigning a portion of said range to each audio file based upon its weight, producing a random number within said range and then selecting said subsequent audio file based upon the audio file assigned to the portion of said range containing said random number.

2. The audio player of claim 1 further comprising a subset creator for limiting the audio files that are considered for selection to a subset of said collection of audio files which are identified as satisfying a user specified criteria.

3. The audio player of claim 1 wherein said desired relationship further comprises a specified correspondence between a key of said current audio file and a key of said subsequent audio file.

4. The audio player of claim 1 wherein said desired relationship further comprises a specified correspondence between a tempo of said current audio file and a tempo of said subsequent audio file.

5. The audio player of claim 1 wherein said audio selector is implemented through a software macro which is downloaded into an existing digital music player.

6. The audio player of claim 1 wherein said weights are assigned in a user selectable manner.

7. The audio player of claim 1 wherein said audio characteristics are user specified.

8. A method of selecting an audio file from a collection of audio files and playing said selected audio file, said method comprising the steps of:

determining an audio characteristic of a currently playing audio file;

processing said collection of audio files to determine audio characteristics possessed by said files in said collection and assigning a weight to each of said files based upon said processing;

selecting a subsequent audio file pseudo-randomly from said collection of audio files by defining a range equal to the total of all assigned weights, assigning a portion of said range to each audio file based upon its weight, producing a random number within said range and then selecting said subsequent audio file based upon the audio file assigned to the portion of said range containing said random number; and playing said subsequently selected audio file.

9. The method of claim 8 wherein the step of determining an audio characteristic of a currently playing audio selection further comprises digitally analyzing said currently playing audio selection.

10. The method of claim 8 wherein said method is implemented through software downloaded into an existing digital music player.

11. The method of claim 8 wherein said weight is determined based upon a specified correspondence between a tempo of said currently playing audio file and a tempo of said subsequent audio file.

12. The method of claim 8 wherein said weight is determined based upon a specified correspondence between a key of said currently playing audio file and a key of said subsequent audio file.

13. Software for selecting a subsequent audio selection from a library of audio files based upon an initial audio selection, said software comprising:

audio analysis software for digitally analyzing said initial audio selection to determine an audio characteristic of said initial audio selection and digitally analyzing said audio files in said library to identify an audio characteristics of each file in said library;

weight assignment software for assigning a weight to each audio file based upon the file's identified audio characteristic and a matching scheme setting forth a desired relationship between said audio characteristic of said initial audio selection and said audio characteristic of said subsequent audio selection; and selection software for pseudo-randomly selecting said subsequent audio selection based upon said assigned weight by defining a range equal to the total of all assigned weights, assigning a portion of said range to each audio file based upon its weight, producing a random number within said range and then selecting said subsequent audio file based upon the audio file assigned to the portion of said range containing said random number.

14. The software of claim 13 further comprising tempo identification software for determining a tempo of an audio file.

15. The software of claim 13 further comprising key identification software for determining a key of an audio file.

16. The software of claim 13 wherein said software is configured as a macro such that it can be added to existing software for a digital music player.

17. The software of claim 13 further wherein said matching scheme is contained in a file matching table.

18. The software of claim 13 wherein said software selects at least two subsequent audio files to play based upon said initial selection.

* * * * *